United States Patent [19]

Lesser et al.

[11] Patent Number: 4,898,088

[45] Date of Patent: Feb. 6, 1990

[54] TOTALLY FUSIBLE TUNNEL VENTILATION DAMPER SYSTEM

[76] Inventors: Norman Lesser, 11 The Bridge, Port Washington, N.Y. 11050; Fred Horowitz, 997 Sheffield Rd., Teaneck, N.J. 07666

[21] Appl. No.: 305,189

[22] Filed: Feb. 2, 1989

[51] Int. Cl.[4] ..... F24F 11/04

[52] U.S. Cl. ..... 98/49; 98/1

[58] Field of Search ..... 98/1, 49, 50, 42.03, 98/42.15; 49/1; 52/232

[56] References Cited

U.S. PATENT DOCUMENTS

| | | | |
|---|---|---|---|
| 609,278 | 8/1988 | Kane . | |
| 1,380,207 | 5/1921 | Hogstrom . | |
| 2,416,284 | 2/1947 | Brown | 52/232 X |
| 3,731,442 | 5/1973 | Kiyoshi | 52/232 |
| 3,818,816 | 6/1974 | Petit | 98/42.03 |
| 3,918,226 | 11/1975 | Naidus | 98/42.15 X |

FOREIGN PATENT DOCUMENTS

| | | | |
|---|---|---|---|
| 2254245 | 7/1975 | France | 98/49 |

*Primary Examiner*—Harold Joyce

*Attorney, Agent, or Firm*—Curtis, Morris & Safford

[57] ABSTRACT

A totally fusible tunnel ventilation damper system which comprises an enlarged ventilation opening partially covered by a sheet of fusible material. The sheet of fusible material is supported by a series of bars traversing the ventilation opening and is secured to the support bars by fire retardant fasteners.

9 Claims, 2 Drawing Sheets

FIG. 2
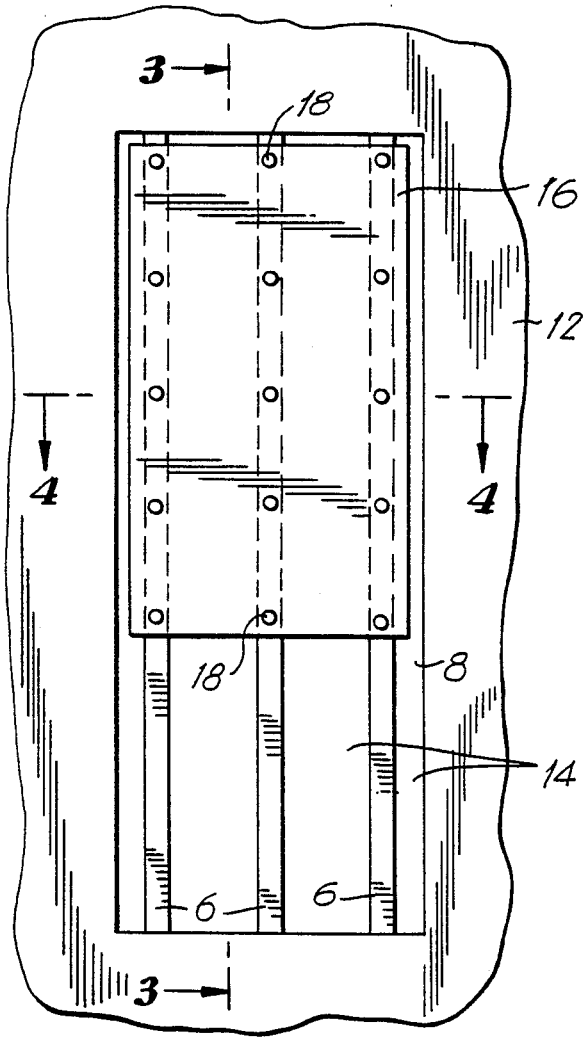
FIG. 3
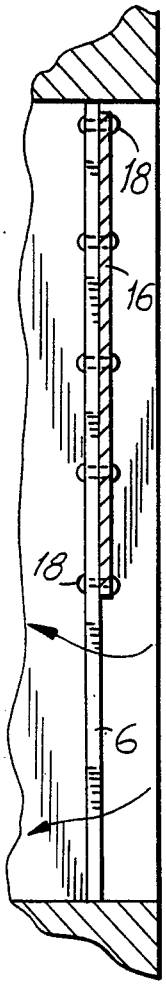
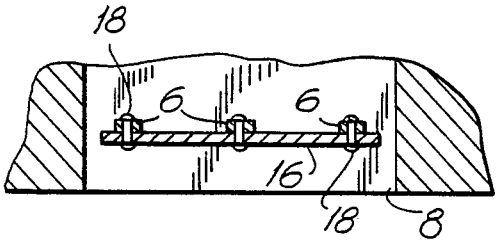
FIG. 4

TOTALLY FUSIBLE TUNNEL VENTILATION DAMPER SYSTEM

BACKGROUND OF THE INVENTION

1. Field of the Invention

The instant invention relates generally to tunnel ventilation systems and, more particularly, to tunnel ventilation systems having fire responsive dampers or other fusible closures.

2. Description of the Prior Art

Numerous structures exist which combine some form of fusible link with a window or other form of damper. When the fusible link is exposed to the heat of a fire it fuses and the window or damper opens. Such devices are typically employed in buildings such as homes. (See e.g. U.S. Pat. Nos. 609,278 and 1,380,207).

Still another technique of providing fire ventilation using fusible materials is that disclosed in U.S. Pat. No. 2,416,284. This latter patent discloses the use of panels of fusible material which form at least a part of the roof of a building. In the event of a fire, the roof panels fuse, creating openings in the roof, thereby providing ventilation into the atmosphere.

Many tunnels employ forced and ducted ventilation systems. Such systems rely on the fixed sized openings used for "normal" ventilation to also provide smoke control and removal in the event of a fire. The actual size of the ventilation openings compared to the vehicular space, the quantity of smoke generated, and the proximity of these openings to a roadway fire are major factors in the efficacy of the smoke control and removal, and systems in which the normal ventilation openings are used for this purpose are severely limited in their smoke removal capability.

Other tunnels employ systems which depend on motorized dampers. These latter systems require periodic maintenance to be operable when needed and have other disadvantages.

OBJECTS OF THE INVENTION

A primary object of the present invention is to provide a tunnel ventilation system which increases its smoke control capabilities in the event of a fire.

Another object is to provide a tunnel ventilation system having a totally fusible damper or other fusible closure which fuses in the event of a fire and increases the size of the ventilation opening.

A further object is to provide a totally fusible tunnel damper or closure system which increases ventilation capability directly at the fire site.

A still further object is to provide a totally fusible tunnel damper or closure system which requires no periodic maintenance.

SUMMARY

The totally fusible tunnel ventilation damper of the present invention comprises an enlarged ventilation opening in the walls or ceiling of a tunnel. A plurality of support bars traverse the opening and provide surfaces for attachment of a panel or sheet of fusible material and the means for retaining the fusible material during the operation of the ventilation system. This panel of fusible material covers only a portion of the enlarged ventilation opening. This results in an opening of "normal" size which permits "normal" air flow under "normal" tunnel operating conditions.

When a fire occurs, and the temperature exceeds a certain point, the sheet of fusible material fuses without significant dripping or releasing any harmful fumes. This provides an increased ventilation area at the point closest to the fire for the removal and control of smoke.

There is no maintenance involved in keeping the totally fusible damper or fusible closure of the present invention in operating condition. If no fire occurs, the ventilation system remains in its "normal" mode, and the panels of fusible material remain in place. If a fire does occur, and the sheets of fusible material are affected, they are just replaced with new sheets.

The present invention as well as further objects and features thereof will become more fully apparent from the following description of a preferred embodiment, when read with reference to the accompanying drawings.

BRIEF DESCRIPTION OF THE DRAWINGS

FIG. 2 is a front elevational view of a totally fusible tunnel damper ventilation device as seen from the line 2—2 in FIG. 1.

FIG. 3 is a vertical sectional view of the totally fusible damper tunnel ventilation device taken along the line 3—3 in FIG. 2.

FIG. 4 is a horizontal sectional view of the totally fusible damper tunnel ventilation device taken along the line 4—4 in FIG. 2.

DESCRIPTION OF A PREFERRED EMBODIMENT

Figure 1:
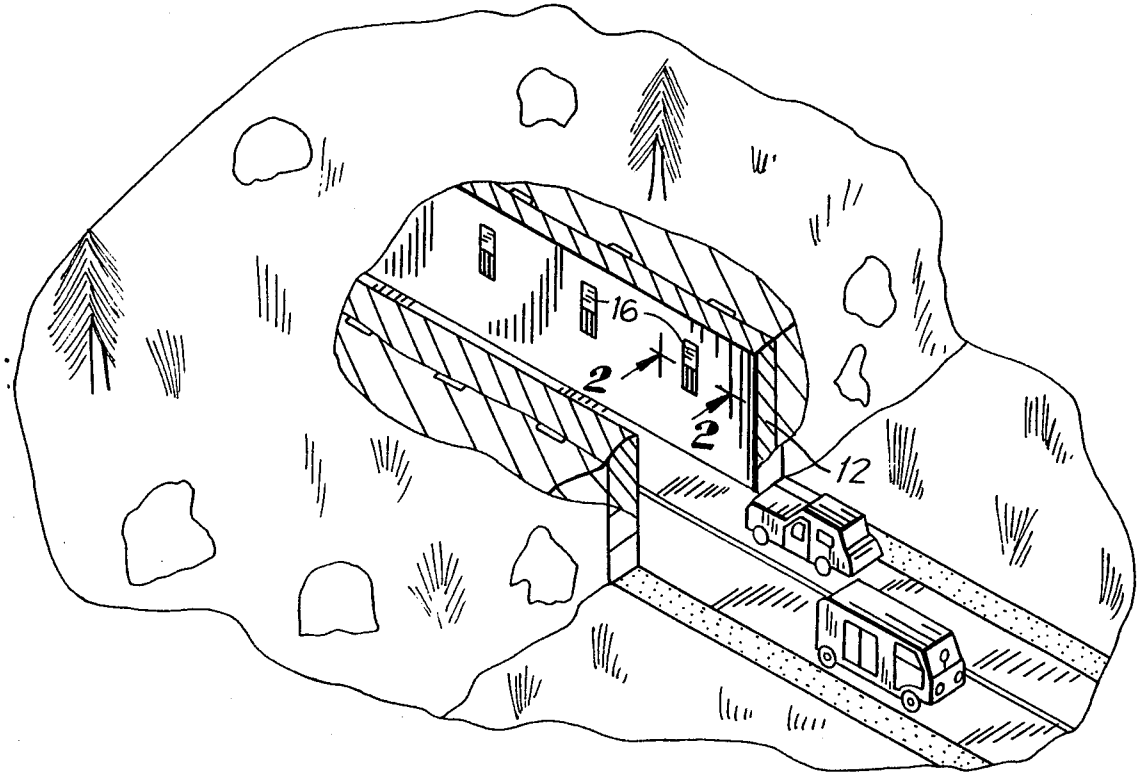
FIG. 1 is a partial cut-away perspective view of an underground tunnel having totally fusible damper tunnel ventilation devices in accordance with an illustrative embodiment of the present invention.

Referring to FIG. 1, for ease of illustration the totally fusible tunnel ventilation damper system has been illustrated as being employed on the walls 12 of a typical tunnel, although the system more commonly is located on the ceiling of the tunnel. The system has the superficial appearance of a standard forced and ducted ventilation system having fixed sized ventilation openings. The system communicates with a conventional exhaust duct (not shown) or reversible supply duct commonly used to remove fumes, stale air, etc. from the tunnel interior.

As best shown in FIG. 2, the overall ventilation opening 8 is enlarged. A series of slats or bars 6 are affixed to a suitable frame on the tunnel wall 12, traverse the enlarged opening 8 and provide a support base. A sheet or panel 16 of totally fusible material covers a portion of the ventilation opening 8. The panel 16 of fusible material should melt, burn or vaporize without substantial dripping at temperatures between 300° F. and 600° F., should not emit toxic fumes, and it should have the strength to withstand the air pressure typical in the ventilating duct and tunnel under normal ventilation system operation. High density polyethylene has all these characteristics and is recommended, although some of the alloys of lead or other low melting point metals also may be suitable. The panel 16 is placed over only a portion of the ventilation opening 8 and is fastened to the slots or bars 6 by a series of fasteners 18. This can most be clearly seen in FIGS. 3 and 4. The fasteners 18 may be of a fire retardant material so that they may be reused to fasten new panels 16 after a fire.

In use, a portion of the enlarged ventilation opening 8 is covered by the totally fusible panel 16 so that balanced or even air distribution results from the remaining portion 14 of the opening 8. When a fire occurs in the tunnel, and the heat exceeds 300° F. to 600° F., the fusible panels 16 adjacent the fire melt or vaporize, thereby increasing the size of the ventilation opening 8 and providing a substantially greater capacity for smoke exhaust. After a fire, the panels 16 are easily replaced by simply fastening new panels 16 on the existing slats 6 with the same or new fasteners 18. No further maintenance is needed at any time.

The invention is useful in standard exhaust systems and in supply systems that are reversed for emergency smoke control, as well as in dedicated smoke control systems both new and existing. The modification of existing facilities is easily accomplished to accommodate this invention.

Although the present invention has been described and illustrated with reference to a specific embodiment, neither the described dimensions, the materials mentioned or other portions of the description should be construed as limited to the details disclosed herein, as the disclosed embodiment is merely illustrative of the invention.

What is claimed is:

1. A fusible tunnel ventilation system comprising:

(a) means defining at least one enlarged ventilation opening in the tunnel;

(b) support means transversing said opening;

(c) a sheet of fusible material covering only a portion of said opening and supported by said support means; and (d) fastening means for fastening said sheet of fusible material to said support means over said portion of said opening.

2. A system according to claim 1, wherein said support means comprises a plurality of bars.

3. A system according to claim 1, wherein said sheet of fusible material is made from high density polyethylene.

4. A system according to claim 1, wherein said fastening means is fire retardant.

5. A fusible tunnel ventilation system comprising:

(a) means defining at least one ventilation opening in the tunnel;

(b) means including a rigid fusible cover sheet at least partially covering said ventilation opening;

(c) support means for supporting said fusible cover sheet over said ventilation opening; and (d) fastener means for fastening said fusible cover sheet in place over said ventilation opening.

6. A system according to claim 5, in which the fusible cover sheet fuses and vaporizes at a temperature within the range of from about 300° F. to about 600° F.

7. A system according to claim 6, wherein said fusible cover means is made from high density polyethylene.

8. A system according to claim 5, wherein said support means comprises a plurality of bars traversing said ventilation opening.

9. A system according to claim 5, wherein said fastener means is made from fire retardant material.

* * * * *